US006856579B1

(12) United States Patent
Benjamin et al.

(10) Patent No.: US 6,856,579 B1
(45) Date of Patent: Feb. 15, 2005

(54) BROADBAND TOWED LINE ARRAY WITH SPATIAL DISCRIMINATION CAPABILITIES

(75) Inventors: Kim C. Benjamin, Portsmouth, RI (US); Kenneth M. Walsh, Middletown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/672,964

(22) Filed: Sep. 29, 2003

(51) Int. Cl.[7] ..... H04R 17/00
(52) U.S. Cl. ..... 367/154
(58) Field of Search ..... 367/106, 130, 367/154, 20, 162, 176, 173, 165

(56) References Cited

U.S. PATENT DOCUMENTS 4,222,114 A * 9/1980 Rolleigh et al. ..... 367/153
4,271,490 A * 6/1981 Minohara et al. ..... 367/154
4,766,575 A * 8/1988 Ehrlich et al. ..... 367/165
4,866,682 A * 9/1989 Uchihashi et al. ..... 367/153
5,272,679 A * 12/1993 Carpenter ..... 367/20
6,255,761 B1 * 7/2001 Benjamin ..... 310/334

FOREIGN PATENT DOCUMENTS

CA 2343687 * 10/2001 ..... G01S/15/00

OTHER PUBLICATIONS

Staal; Use and Evolution of a Modular Digital Hydrophone Array; OCEANS, vol.: 19, Sep. 1987; pp.: 161 166.*

* cited by examiner

*Primary Examiner*—Daniel Pihulic
(74) *Attorney, Agent, or Firm*—James M. Kasischke; Michael F. Oglo; Jean-Paul A. Nasser

(57) ABSTRACT

A modular sub-array assembly of a composite towed array includes a multi-chamber support structure with plural discrete chambers, an acoustically absorptive hub formed at a central axis of the multi-chamber support structure, and a sensor element in each of the chambers of the multi-chamber support structure. The multi-chamber support structure is an integrally formed viscoelastic cylindrical housing with an array of radially oriented chambers. Each sensor element is secured within the selected chamber of the multi-chamber support structure and to an outer radial surface of the acoustically absorptive hub by a structural adhesive. Plural sub-array modules may be assembled together to form a single towed array.

18 Claims, 2 Drawing Sheets

BROADBAND TOWED LINE ARRAY WITH SPATIAL DISCRIMINATION CAPABILITIES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to a broadband, towed line array with spatial discrimination capabilities. More particularly, this invention relates to towed line array technology that relies on simple monopole sensors typically operating in a receive mode only and utilizing a novel modular sub-array arrangement.

(2) Description of the Prior Art

Several underwater sonar applications exist for steered directional acoustic beams. Although the current towed systems provide spatial discrimination in the direction of tow, a left right ambiguity exists due to the omni-directional sensors employed. Given the orientation of the array in revolution, a directional sensor would resolve this ambiguity and provide essentially three-dimensional spatial discrimination.

Typical sensors used in today's towed line arrays consist of solid piezoceramic spheres or cylinders. However, in some special cases they consist of fiber optic cables wound onto mandrels or miniature flextensional transducers. In any case, the element dimensions are small compared to the acoustic wavelength, and thus these sensors operate below their first mechanical resonance.

The following patents, for example, disclose towed arrays, but do not disclose a modular sub-array such as that taught in the curent invention which may be assembled into a more comprehensive towed array.

U.S. Pat. No. 4,222,114 to Rolleigh et al.;

U.S. Pat. No. 4,271,490 to Minohara et al.;

U.S. Pat. No. 4,766,575 to Erlich et al.;

U.S. Pat. No. 4,866,682 to Uchihashi et al.; and

U.S. Pat. No. 6,255,761 to Benjamin.

Specifically, Rolleigh et al. disclose a cylinder array radiator that reduces the intensity of energy radiated in undesirable directions. The radiator is constructed so that vertical staves placed on the face of a cylinder are staggered in the vertical direction by a predetermined distance to cancel energy in the undesirable directions.

The patent to Minohara et al. discloses an ultrasonic detection system having an array of ultrasonic transducers that are uniformly closely disposed relative to each other such that the active surfaces for transmission or reception are maintained on a straight or curved line. The transducers form radiation or reception beams in a specific direction. Beam orientation is accomplished by selecting a group of transducers from the array and/or respectively applying appropriate phase-shifts to the signals to be fed to each of the transducers, or to the signals produced from each of the transducers. Shields are maintained between two adjacent transducers for suppression of sidelobes.

Ehrlich et al. disclose a cylindrical array employing rectangular planar array segments which extend in the axial direction when assembled on a cylindrical conducting plate having flat longitudinal portions to which the planar array segments are attached. Each planar array segment comprises two columns of planar transducer elements with each column extending in the axial direction of the cylinder. The acoustic center of each transducer lies on the circumference of a right circular cylinder. The acoustical requirements of a cylindrical array are satisfied to allow multiple beams to be formed with a minimum of complexity and with the same versatility as in the curved array segment cylindrical array embodiment.

Uchihashi et al. disclose an ultrasonic device comprising a plurality of transducer elements arranged in rows and columns and acoustic insulation material maintained between each two adjacent rows of transducer elements. The ultrasonic device comprises (i) a plurality of rows of the transducer elements, each row being disposed on an imaginary circle, (ii) a plurality of circular plates each supporting one of said rows, and (iii) spacers for spacing adjacent plates of the plurality of plates at a predetermined space interval, thereby forming a cylindrical array.

The patent to Benjamin discloses a piezoelectric composite transducer and method for making the same. A block of piezoelectric material has a common base and a plurality of uniform-length rods extending from the common base in a parallel spaced-apart fashion to define an array. A first surface region is defined at outboard ends of the rods and a side region is defined about the periphery of the array. Electric conductors extend through the side region, are routed parallel to the first surface region, and are then led substantially parallel to the rods to the first surface region. Spaces between the rods are filled up to the first surface region with a visoelastic material. The common base of the block is then removed such that a second surface region parallel and opposite the first surface region is defined. Electrodes are deposited at the first surface region to be in contact with the rods and in electrical contact with the electric conductors. A ground electrode is deposited at the second surface region to be in contact with the rods. The resulting piezoelectric composite transducer can be heated and shaped to conform to complex curves.

It should be understood that the present invention would in fact enhance the functionality of the above patents by providing a modular sub-array for use with a plurality of other modular sub-arrays. It includes a multi-chamber support structure with an acoustically absorptive hub as a basis for the sub-array.

SUMMARY OF THE INVENTION

Therefore it is an object of this invention to provide a broadband towed line array.

Another object of this invention is to provide a towed line array with directional sensors.

Still another object of this invention is to provide a towed line array having modular sub-arrays.

A still further object of the invention is to provide towed line array in which a multi-chamber support structure defines each modular sub-array.

Yet another object of this invention is to provide a towed line array in which discrete sensor elements are housed within the chambers of the multi-chamber support structure for each modular sub-array.

In accordance with one aspect of this invention, there is provided a towable array having a multi-chamber support structure and an acoustically absorptive hub formed at a central axis of the multi-chamber support structure. A sensor element substantially conforms in shape to and is selectively secured in each chamber of the multi-chamber support structure and are therefore mechanically isolated from each other. Accordingly, each sub-array module contains multiple sensors along with their associated transmit and receive electronics.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
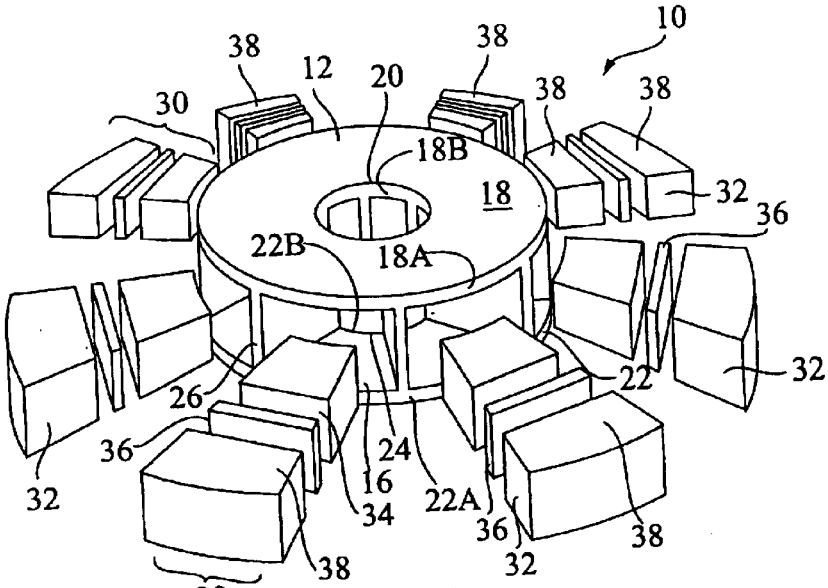
FIG. 1 is an exploded perspective view of a cylindrical sub-array module according to a preferred embodiment of the present invention.

In general, the present invention is directed to a multi-element transducer array packaged in a modular cylindrical configuration suitable for towing underwater, as generally shown at 10 in the exploded perspective view FIG. 1. The modular cylindrical configuration 10 is a sub-array module of plural sub-array modules that may be assembled as shown, by way of example only, in FIGS. 4A through 4D and as will be further described below.

Figure 2A:
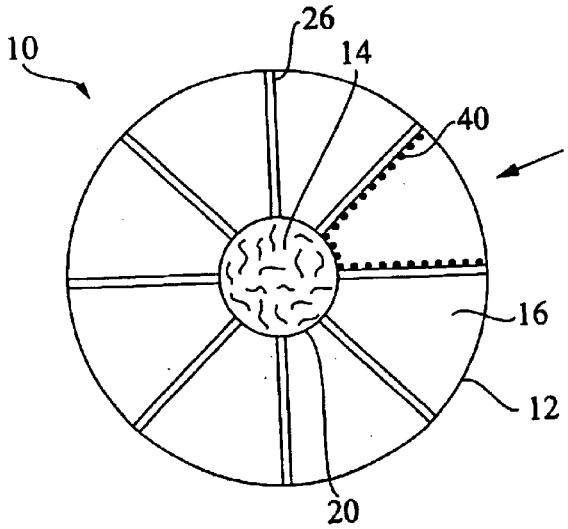
FIG. 2A is a top plan view of the cylindrical sub-array module of FIG. 1.
Figure 2B:
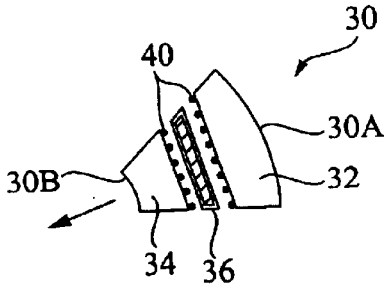
FIG. 2B is a top plan view of a sensor element included in cylindrical sub-array module of FIG. 1.
Figure 3A:
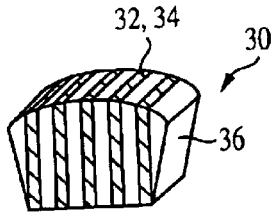
FIGS. 3A through 3D are examples of sensor elements of the present invention.
Figure 3B:
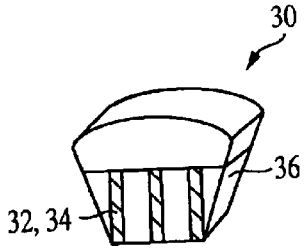
Figure 3C:
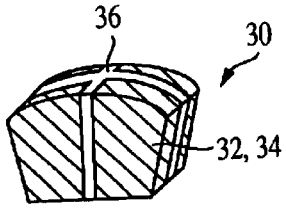
Figure 3D:
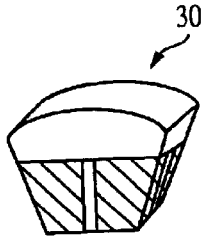
Figure 4A:
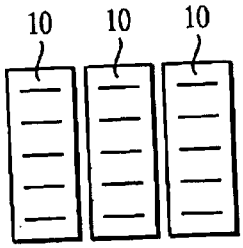
FIGS. 4A through 4D are side perspective views of various sub-array module geometries assembled into larger arrays of modules according to the present invention.
Figure 4B:
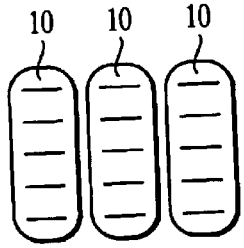
Figure 4C:
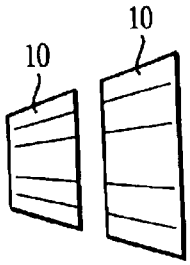
Figure 4D:
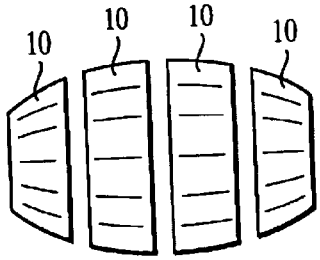

Referring to FIGS. 1, 2A and 2B, the modular configuration 10 includes a multi-chamber support structure or housing 12 surrounding an acoustically absorptive hub 14. The hub 14 defines an axial center of the multi-chamber support structure 12 and plural chambers 16 thereof are formed to extend radially from the hub 14. In further detail, the multi-chamber support structure 12 will include an upper plate 18 having an opening 20 centrally formed therein, a lower plate 22 opposing the upper plate 18 and having an opening 24 centrally formed therein, and a plurality of sectioning walls 26 perpendicular to and spacing the upper and lower plates 18, 22 apart from each other. Each of the plurality of sectioning walls 26 will preferably extend from an outer peripheral edges 18A, 22A of the upper and lower plates 18, to an inner peripheral edges 18B, 22B thereof and in conjunction with the centrally formed and aligned openings 20, 24. It is at the space defined by the centrally formed and aligned openings 20, 24, and inner edges of the plurality of sectioning walls 26 where the acoustically absorptive hub 14 is located.

The multi-chamber support structure 12 is formed of a viscoelastic material so as to provide isolating, waterproofing, and other protective properties to the modular array. Further, the multi-chamber support structure 12 including the upper and lower plates 18, 22, and the plural sectioning walls 26, may be integrally formed as a one-piece construction or assembled together from separate pieces according to the manufacturer.

The arrangement of the multi-chamber support structure 12, and particularly the plural sectioning walls 26 thereof, is specifically intended to afford mechanical isolation between individual composite sensor elements 30 within the modular sub-array 10. These composite sensor elements 30 are, by way of example, a plurality of piezoelectric polymer composite elements.

A first example of an individual sensor element 30 is shown in FIG. 2B as a piezoelectric element including multiple layers of active piezocomposite material 32, 34, and an electrical isolator 36. Electrodes 38 are formed on the outer 30A and inner 30B surfaces of the sensor element 30 using electroplated copper or any other suitable technique known in the art. A structural adhesive 40 is used to join the layered assembly of active layers 32, 34 and isolator 36 members together. The structural adhesive 40 is also used to bond the individual sensor elements 30 to the support structure 12 at inner surfaces of each chamber 16 as shown by the dotted lines, and to the outer peripheral surface 14*a* of the acoustically absorptive hub 14.

Sensor elements 30 are addressed by way of cabling embedded within the piezocomposite substrate. This means of addressing is known in the art and is not intended to form a part of this invention, and therefore will not be described in further detail for the sake of simplicity of this disclosure.

Referring now to FIGS. 3A through 3D, there are illustrated various piezoelectric polymer composite sensor element configurations 30, any of which would be suitable for use in the modular sub-array 10 of the present invention. These arrangements are achieved by varying the geometry of the piezoceramic 32, and polymer 36 phases as shown. The illustrations are not intended to limit the particular construction of composite sensor elements 30 of the present invention, but are intended to be illustrative examples only.

In addition, there are an extensive number of array or sub-array profiles along the tow direction that will be available to one of ordinary skill in the art, as exemplified by FIGS. 4A through 4D. Note that FIGS. 4A through 4D are viewed in the tow direction. For example, a side view of the modular sub-array 10 of FIG. 1 may be cylindrical as in FIG. 4A, conical as in FIG. 4B, cylindrical with arcuate outer peripheries as in FIG. 4C, or arcuately increasing and decreasing as in FIG. 4D. The geometries are nearly limitless and may be modified according to end use while still employing the features of a multi-chamber support structure 12 with an acoustically absorptive hub 14, and plural mechanically isolated sensor elements 30 housed therein as set forth above.

Unlike conventional towed array designs, the radiating aperture in this case is delineated in both length and revolution. Thus, the sub-array module 10 is capable of providing spatial discrimination (a steered acoustic beam) in three dimensions.

The towed array will consist of a plurality of modular sub-arrays 10 having cylindrical geometry. The number of sub-array modules 10 required would depend on the applications, and is limited only by the towing capability of the vehicle. Each sub-array module 10 contains multiple sensors 30 along with their associated transmit and receive electronics.

The modular sensor element 30 sizes and shapes can be uniform or made to vary according to the intended application. Additionally each layer within the sensor element 30 may be independently addressed in order to electronically compensate for response variations that are typical when extending the sonar system operation above the element's first thickness mode resonance. Therefore, broadband signals like FM, or phase coded, CHIRPS may be conveyed over a broad frequency range.

The disclosed invention provides several major advantages over conventional towed line arrays. These include but are not limited to: a dual transmit/receive operation; three-dimensional spatial discrimination; and broadband operation, which aside from the element's individual layers, may be addressed separately to further extend a sonar system's operational bandwidth. Techniques involving compensation electronics, known to the art, may be employed to extend the layered element response well past the first thickness mode resonance, and integral electronics allow modular sensor design.

In view of the above detailed description, it is anticipated that the invention herein will have far reaching applications other than those of towed underwater arrays.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A modular sensor assembly of a towed array comprising:

a support structure having opposed upper and lower plates spaced apart by vertical sectioning walls and defining discrete chambers of said support structure;

an acoustically absorptive hub positioned centrally in said support structure and in communication with said discrete chambers; and a sensor element secured in a selected chamber of said support structure.

2. The assembly according to claim 1 wherein said support structure is an integrally formed-viscoelastic housing.

3. The assembly according to claim 1 wherein said support structure is a cylindrical housing having a central axis with said vertical sectioning walls arranged radially thereabout, said acoustically absorptive hub being positioned at the central axis of said support structure.

4. The assembly according to claim 3 wherein said support structure is integrally formed of a viscoelastic material.

5. The assembly according to claim 1 wherein said sensor element is secured within said selected chamber of the support structure by structural adhesive.

6. The assembly according to claim 5 wherein said sensor element is secured to an outer surface of said acoustically absorptive hub with structural adhesive.

7. The assembly according to claim 1 wherein said sensor element is secured to an outer surface of said acoustically absorptive hub with a structural adhesive.

8. The assembly according to claim 1 wherein said sensor element is a piezo-electric composite element.

9. The assembly according to claim 8 wherein said sensor element comprises:

at least two layers of piezo-electric composite, each layer having upper surface and a lower surface; and an electrical insulator positioned between adjacent ones of said at least two layers.

10. The assembly according to claim 9 wherein said at least two layers are disposed at first and second different distances from said acoustically absorbing hub.

11. The assembly according to claim 9 wherein said at least two layers are disposed in planes parallel to a radius from said acoustically absorbing hub.

12. The assembly according to claim 9 wherein said electrical insulator is secured between a first layer of said at least two layers and a second layer of said at least two layers with a structural adhesive.

13. The assembly according to claim 9 further comprising an electrode on at least one of the upper and lower surfaces of each said sensor element.

14. The assembly according to claim 1 wherein a separate said sensor element is secured in each of said discrete chambers of said support structure.

15. The assembly according to claim 1 wherein:

said support structure is a cylindrical housing having a central axis with said vertical sectioning walls arranged radially thereabout, said acoustically absorptive hub being positioned at the central axis of said support structure; and said sensor element having an inner surface oriented toward said acoustically absorptive hub and an outer surface positioned away from said cylindrical housing, wherein said inner surface conforms to an outer surface of said acoustically absorptive hub and said outer surface conforms to the shape of said cylindrical housing.

16. The assembly according to claim 15 wherein:

said vertical sectioning walls of said cylindrical housing have a peripheral shape; and said outer surface of said sensor element has a shape conforming with the peripheral shape of said vertical sectioning walls.

17. The assembly according to claim 1 wherein:

said support structure is a frusto-conical housing having a central axis with said vertical sectioning walls arranged radially thereabout, said acoustically absorptive hub being positioned at the central axis of said support structure; and said sensor element having an inner surface oriented toward said acoustically absorptive hub and an outer surface positioned away from said cylindrical housing, wherein said inner surface conforms to an outer surface of said acoustically absorptive hub and said outer surface conforms to the shape of said frustoconical housing.

18. The assembly according to claim 17 wherein:

said vertical sectioning walls of said frusto-conical housing have a peripheral shape; and said outer surface of said sensor element has a shape conforming with the peripheral shape of said vertical sectioning walls.

* * * * *